US010415421B2

(12) United States Patent
Arnold et al.

(10) Patent No.: US 10,415,421 B2
(45) Date of Patent: Sep. 17, 2019

(54) THRUST RATING DEPENDENT ACTIVE TIP CLEARANCE CONTROL SYSTEM

(71) Applicant: UNITED TECHNOLOGIES CORPORATION, Farmington, CT (US)

(72) Inventors: Jason Arnold, Rocky Hill, CT (US); Graham Ryan Philbrick, Durham, CT (US); Patrick D. Couture, Tolland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 541 days.

(21) Appl. No.: 15/425,689

(22) Filed: Feb. 6, 2017

(65) Prior Publication Data

US 2018/0223684 A1 Aug. 9, 2018

(51) Int. Cl.
*F01D 11/24* (2006.01)
*F01D 25/12* (2006.01)

(52) U.S. Cl.
CPC ..... *F01D 11/24* (2013.01); *F01D 25/12* (2013.01); *F05D 2220/323* (2013.01);
(Continued)

(58) Field of Classification Search
CPC ..... F01D 11/24; F01D 25/12; F05D 2240/11; F05D 2220/323; F05D 2260/20; F05D 2260/821; F05D 2270/00; F05D 2270/05; F05D 2270/20; F05D 2270/44; F05D 2270/54
See application file for complete search history.

(56) References Cited

U.S. PATENT DOCUMENTS 4,487,016 A * 12/1984 Schwarz ..... F01D 5/082 415/116
5,005,352 A * 4/1991 Schwarz ..... F01D 11/24 60/782
(Continued)

FOREIGN PATENT DOCUMENTS

EP 1754861 A2 2/2007
EP 1854961 A2 11/2007
(Continued)

OTHER PUBLICATIONS

European Search Report for Application No. 18155173.0-1006; dated Jul. 4, 2018; 6 pgs.

*Primary Examiner* — Ninh H. Nguyen
*Assistant Examiner* — Jesse M Prager
(74) *Attorney, Agent, or Firm* — Cantor Colburn LLP

(57) ABSTRACT

Disclosed is an active tip clearance control system (ATCCS) for a gas turbine engine, having an electronically controlled regulating valve directing cooling airflow to a turbine case, and an engine electronic control (EEC), controlling the electronically controlled regulating valve, wherein the EEC controls the electronically controlled regulating valve to regulate cooling airflow according to a selected target blade tip clearance schedule, and wherein the selected target blade tip clearance schedule is selected before or after an engine cycle, from of a plurality of target blade tip clearance schedules, each correlating to one of a plurality of thrust rating applications for the engine.

14 Claims, 6 Drawing Sheets

(52) U.S. Cl.
CPC ..... *F05D 2240/11* (2013.01); *F05D 2240/30* (2013.01); *F05D 2260/20* (2013.01); *F05D 2270/00* (2013.01); *F05D 2270/05* (2013.01); *F05D 2270/20* (2013.01); *F05D 2270/44* (2013.01); *F05D 2270/54* (2013.01)

(56) References Cited

U.S. PATENT DOCUMENTS

| | | | | |
|---|---|---|---|---|
| 5,081,830 | A * | 1/1992 | Schwarz | F02C 9/16 60/782 |
| 7,465,145 | B2 * | 12/2008 | Kane | F01D 11/20 415/1 |
| 2007/0276578 | A1 * | 11/2007 | Herron | F01D 11/24 701/100 |
| 2009/0037035 | A1 * | 2/2009 | Hershey | F01D 11/24 701/3 |
| 2010/0247297 | A1 * | 9/2010 | Legare | F01D 11/24 415/173.1 |
| 2015/0159500 | A1 * | 6/2015 | Carlucci | F01D 11/24 415/1 |
| 2016/0047269 | A1 * | 2/2016 | Zacchera | F01D 21/003 416/1 |

FOREIGN PATENT DOCUMENTS

| | | | |
|---|---|---|---|
| EP | 2843198 | A1 | 3/2015 |
| GB | 2460948 | A | 12/2009 |

* cited by examiner

THRUST RATING DEPENDENT ACTIVE TIP CLEARANCE CONTROL SYSTEM

BACKGROUND

Control of the radial clearance between the tips of rotating blades and the surrounding annular shroud in axial flow gas turbine engines improves engine efficiency. For example, by reducing the blade tip to shroud clearance, designers can reduce the quantity of turbine working fluid which bypasses the blades, thereby increasing engine power output for a given fuel or other engine input. On the other hand, blade tip to shroud contact leads to friction losses and wearing of parts. "Active clearance control" refers to clearance control arrangements wherein a quantity of working fluid, such as air, is employed by the clearance control system to regulate the thermal expansion of engine structures, thereby controlling the blade tip to shroud clearance.

BRIEF DESCRIPTION

Disclosed is an active tip clearance control system (ATCCS) for a gas turbine engine, including an electronically controlled regulating valve directing cooling airflow to a turbine case, and an engine electronic control (EEC), controlling the electronically controlled regulating valve, wherein the EEC controls the electronically controlled regulating valve to regulate cooling airflow according to a selected target blade tip clearance schedule, and wherein the selected target blade tip clearance schedule is selected before or after an engine cycle, from a plurality of target blade tip clearance schedules, each correlating to one of a plurality of thrust rating applications for the engine.

In addition to one or more of the features described above, or as an alternative, further embodiments may include that each of the target blade tip clearance schedules regulates cooling airflow for each phase of flight and for throttle excursions within and between each phase of flight.

In addition to one or more of the features described above, or as an alternative, further embodiments may include that the EEC is a full authority digital engine control (FADEC).

In addition to one or more of the features described above, or as an alternative, further embodiments may include a turbine case, a bladed rotary component supported by a spool, a shroud disposed radially within and fixedly supported by the turbine case, wherein blade tips are radially within and proximate to the shroud.

In addition to one or more of the features described above, or as an alternative, further embodiments may include that the electronically controlled regulating valve is exterior to the turbine case, and cooling airflow is directed therefrom toward a radially exterior side of the turbine case, and against thermally exposed portions of the turbine case and shroud connectors.

Also disclosed is a gas turbine engine including a turbine, the turbine including a bladed rotary component supported by a spool, a turbine case, and the active tip clearance control system (ATCCS).

Also disclosed is a method for providing active tip clearance control to a gas turbine engine, the method including selecting, by a computer processor, before or after an engine cycle of the gas turbine engine, a thrust rating application for a next engine cycle that differs from a currently selected thrust rating application, obtaining, by the computer processor, a target blade tip clearance schedule from of a plurality of target blade tip clearance schedules, each of the plurality of target blade tip clearance schedules correlating to one of a plurality of thrust rating applications for the engine, and forwarding cooling airflow toward a turbine case by controlling an electronically controlled regulating valve pursuant to the selected target blade tip clearance schedule.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
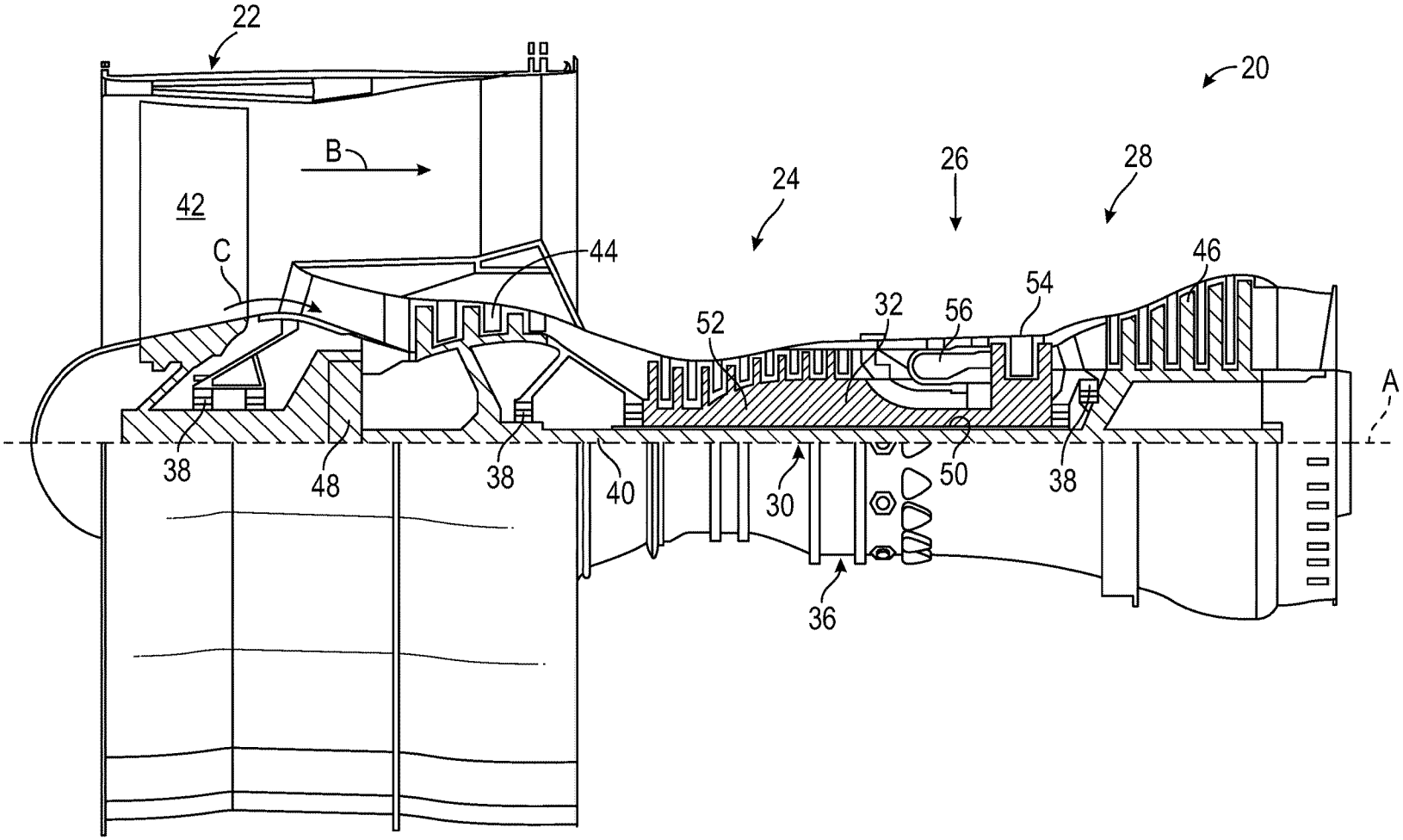
FIG. 1 illustrates a cross section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Referring to FIGS. 2 through 5, a gas turbine engine 110 is illustrated with an active tip clearance control system (ATCCS) 114. The active tip control system is also known as trim control. Reference is made to U.S. Pat. No. 7,491,029, the contents of which are incorporated herein by reference. The illustrated engine configuration in FIGS. 2 through 5 is not intended to limit the scope or applicability of the disclosed embodiments.

Similar to the engine 20 illustrated in FIG. 1, the engine 110 in FIGS. 2 through 5, may include a compressor, a combustor 111 and a turbine 112. The turbine 112 may have of a low-pressure turbine section and a high-pressure turbine engine section.

Figure 2:
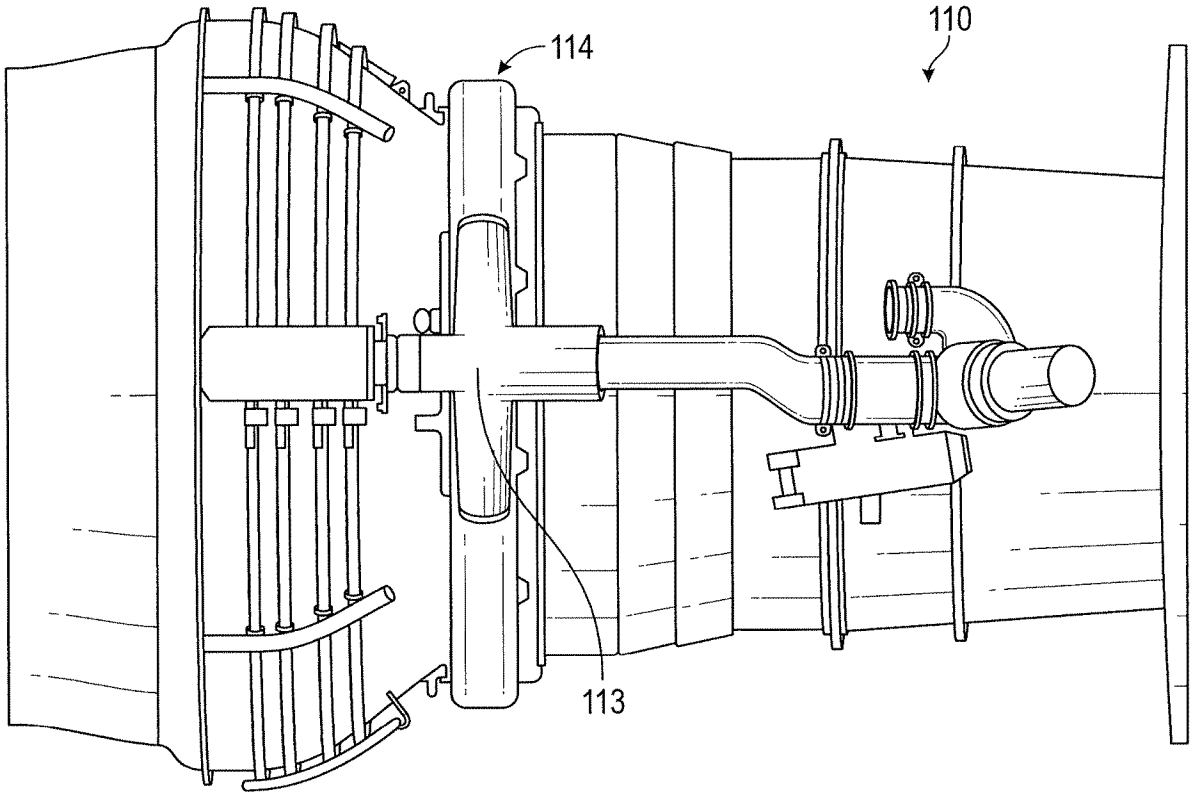
FIG. 2 illustrates an exterior view of a turbine module having an active tip clearance control system, according to an embodiment.
Figure 3:
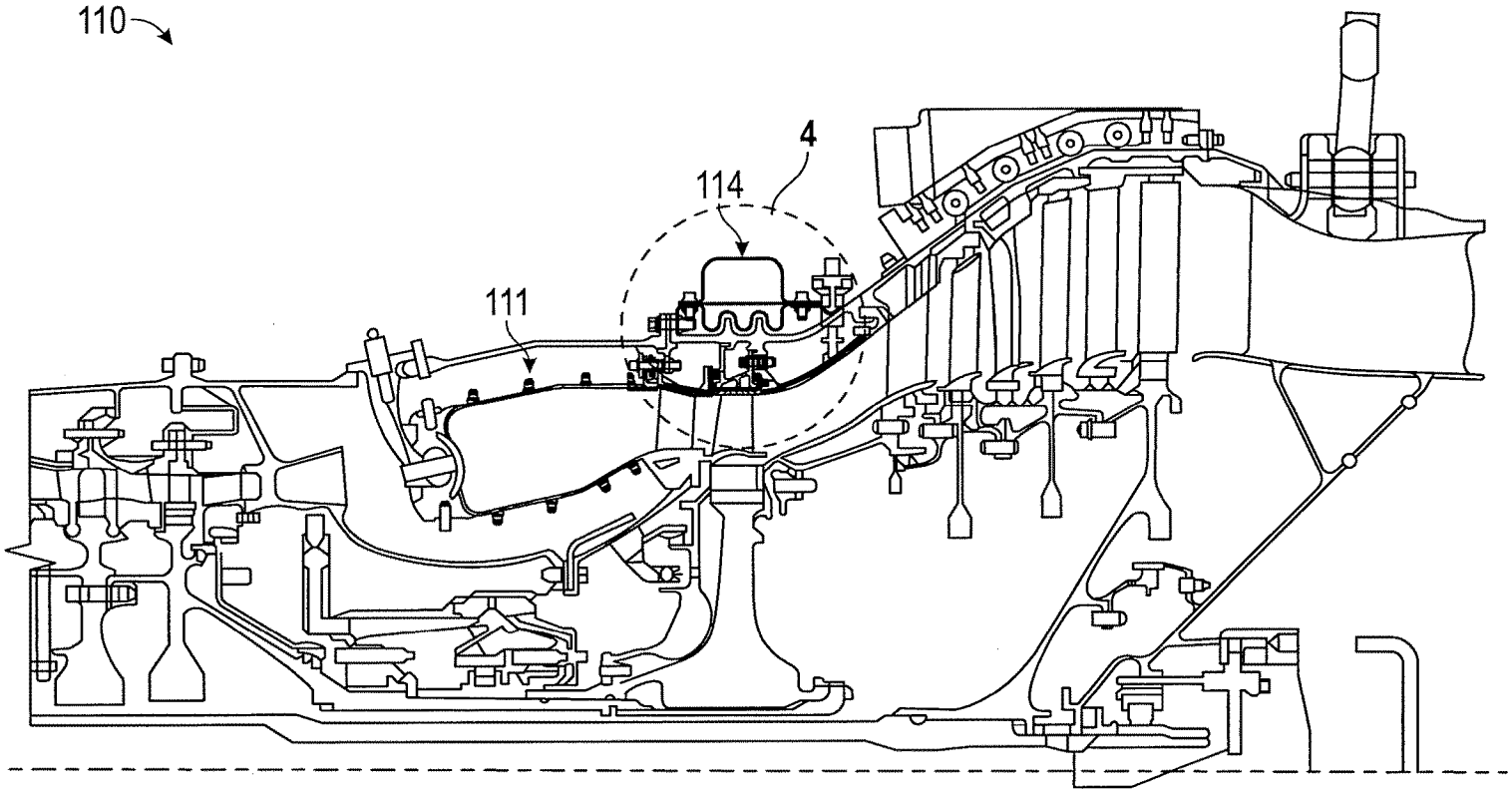
FIG. 3 illustrates a cross sectional view of a gas turbine engine having an active tip clearance control system, according to an embodiment.

FIG. 3 illustrates the active tip clearance control system 114 integrally mounted to the turbine 112. It is contemplated that the active tip clearance control system 114 may be used for either high-pressure or low-pressure applications. In FIGS. 2-5, the active tip clearance control system 114 is be mounted to the high-pressure turbine section where the operating conditions, e.g., temperature and pressure, are most extreme.

Figure 4:
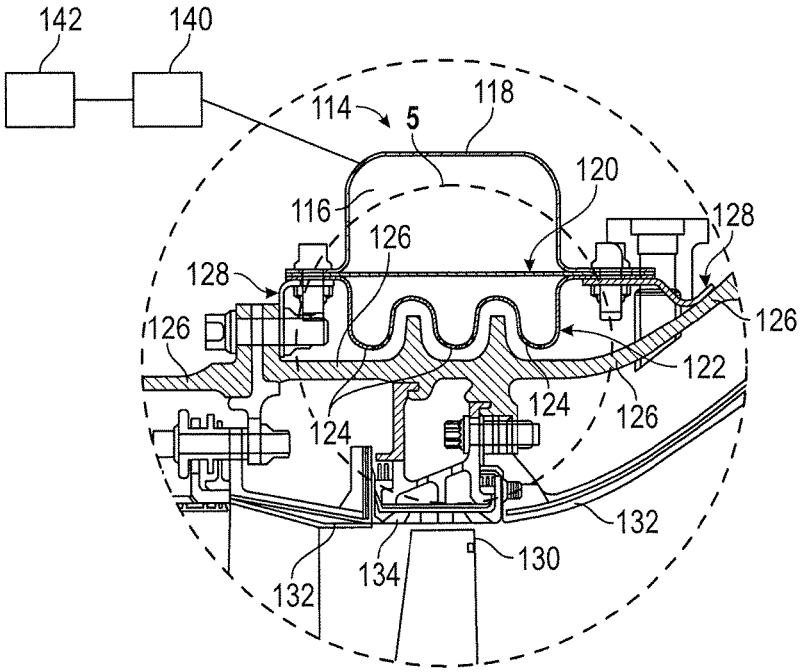
FIG. 4 illustrates a portion of the gas turbine engine of FIG. 3, further illustrating the active tip clearance control system, according to an embodiment.

As illustrated in FIG. 4, the active tip clearance control system 114 may have a plenum 116, defined by a manifold 118 disposed radially exterior to, and in connection with, a divider plate 120. The divider plate 120 may be disposed radially exterior to, and in connection with, a shielding plate 122. The shielding plate 122 may have a plurality of apertures 124. The manifold 118, divider plate 120 and shielding plate 122 may be mounted to a case 126 of the turbine 112 via one or more integral mounting devices 128. Suitable integral mounting devices 128 may include, e.g., brackets, screws, bolts, punches, rivets, welds, clips, and combinations thereof.

A quantity of cooling airflow may be introduced via the active tip clearance control system 114 from the atmosphere, from, e.g., ram air, or bled from the compressor stage of the gas turbine engine 110 and into an aperture 113, illustrated in FIG. 2, of the manifold structure 118. The cooling airflow, not subjected to the extreme operating conditions within the gas turbine engine 110, possesses a temperature lower than the operating temperature of the engine 110, thus providing a cooling effect, i.e. thermal contraction of the cooled materials.

Figure 5:
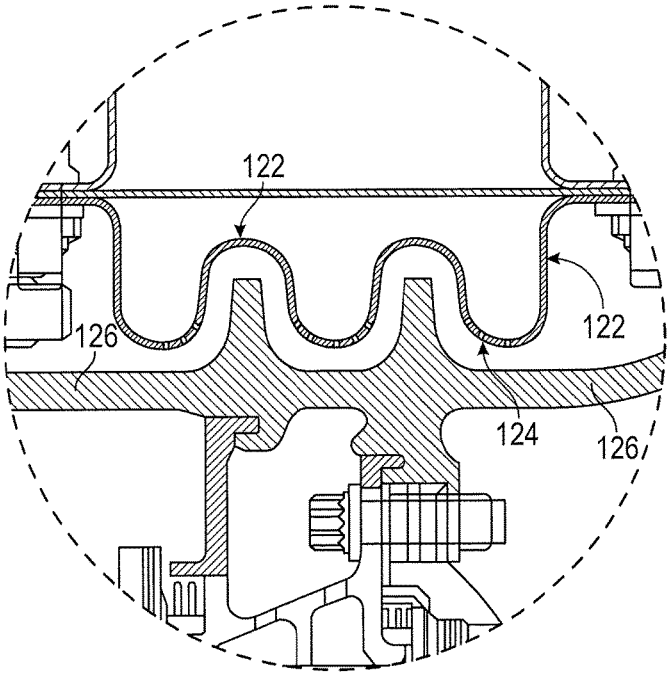
FIG. 5 illustrates a portion of the active tip clearance control system illustrated in FIG. 4, according to an embodiment.

The apertures 124 in the shielding plate 122 permit cooling airflow to impinge the case 126. As illustrated in FIGS. 4 and 5, the cooling airflow travels through the plenum 116 and enters the turbine 112 through the apertures 124 in the shielding plate 122. The cooling airflow circulates and exits into the engine's working environment between shielding plate 122 and case 126. This circulation cools the case 126 and mounting devices 128, enabling thermal contraction of these components, drawing a turbine shroud 132 and abradable material 134, each connected to the case 126, radially away from blade tips 130, decreasing thermally induced clearance interference.

Cooling airflow, supplied through the active tip clearance control system 114, is funneled through an electronically controlled regulating valve 140, illustrated schematically in FIG. 4. The valve 140 is electronically controlled, e.g., by an electronic engine control (EEC) 142, such as a full authority digital engine control (FADEC), also illustrated schematically. The control of the valve 140 is according to a preprogrammed schedule that correlates the engine tip clearance requirements and engine spool speeds at each flight phase, e.g. takeoff, climb, cruse, loiter, land, and periods where throttle excursion are otherwise required.

Engines, such as engine 110, are designed to be used with different aircrafts requiring different levels of thrust, commonly referred to as thrust ratings. For each engine, the amount of cooling airflow needed, in order to provide the preferred blade tip clearance control, changes based on the aircraft thrust rating. Placing the engine 110 in an aircraft with a relatively higher rating will expose the engine 110 to greater thermal stresses, and therefore greater thermal expansions, requiring more cooling airflow to achieve preferred blade tip clearance control.

Figure 6:
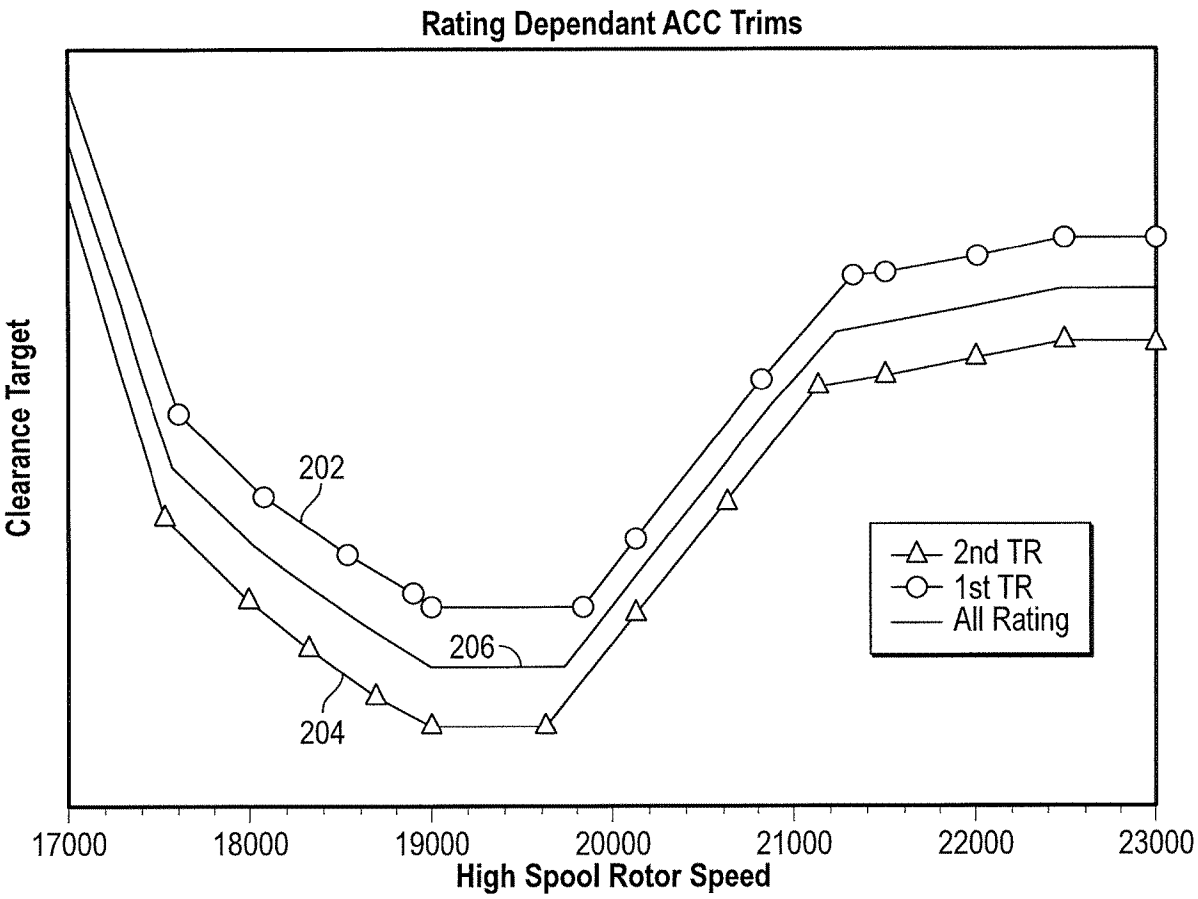
FIG. 6 graphically illustrates target clearances against high spool rotor speed, according to an embodiment.

FIG. 6 illustrates different curves correlating blade tip clearance targets to high spool rotor speeds for an engine 110 operating under different thrust rating applications. In the illustration, thrust required by the engine 110 in a first thrust rating application, graphed by first curve 202, is greater than thrust required in a second thrust rating application, graphed by second curve 204. As a result, the blade tip clearance targeted by the active tip clearance control system 114 under the first thrust rating 202 is greater than the blade tip clearance targeted under the second thrust rating 204.

Typically, an active tip clearance control system 114 controls airflow, using the EEC 142 to operate the valve 140, pursuant to a middle ground clearance schedule in all anticipated applications during the service life of the engine 110. The third curve 206 in FIG. 6 represents a middle ground blade tip clearance target for an active tip clearance control system 114 in the engine 110 depicted in that figure.

Having the active tip clearance control system 114 control the valve 140 pursuant to a schedule defined by curve 206 for all thrust rating applications may not be ideal. When the engine 110 is used to achieve the higher thrust rating, controlling the valve 140 pursuant to the first curve 202 may not provide enough cooling airflow. This results in a the occurrence of a certain amount of blade tip rub, friction losses, efficiency losses and a decrease in the life of engine parts. When the engine 110 is used to achieve the lower thrust rating, controlling the valve 140 pursuant to the second curve 204 may provide too much cooling airflow. This results in excessive blade tip clearance, allowing core air to escape around turbine blade edges instead of driving the turbine, reducing engine efficiencies.

In the disclosed active tip clearance control system 114, the EEC 142 may be programmed to operate the valve 140 pursuant to plural clearance target curves 202, 204, corresponding to plural anticipated thrust rating applications during the service life of the engine 110. The EEC 142 may control the electronically controlled regulating valve 140 to allow more cooling airflow to the case 126 and shroud connectors 128 under the higher thrust rating application, and less cooling airflow under the lower thrust rating application. As a result, the same engine 110 may be used in plural aircrafts, having plural thrust ratings, without resulting in the inefficiencies of the active tip clearance control system 114 operating the valve 140 pursuant to middle ground clearance target curve 206.

The EEC 142 in the active tip clearance control system 114 may be switched to control the valve 140 pursuant to any of the plural blade tip clearance target curves, any time before or after an engine cycle, i.e., before engine start or after engine shutdown. Periods for switching include prior to use in an aircraft, e.g., at or before install of the engine 110 in a nacelle mounted to an airframe, or upon a first flight after an install. The EEC 142 for the active tip clearance control system 114 may be an integral part of the FADEC, or may be provided separately from the FADEC, in which case the EEC 142 may electronically communicate blade tip clearance control data and/or thrust rating data to the FADEC. If not part of the FADEC, the EEC 142 may be located on the engine 110, elsewhere in the aircraft, or at a remote location.

Figure 7:
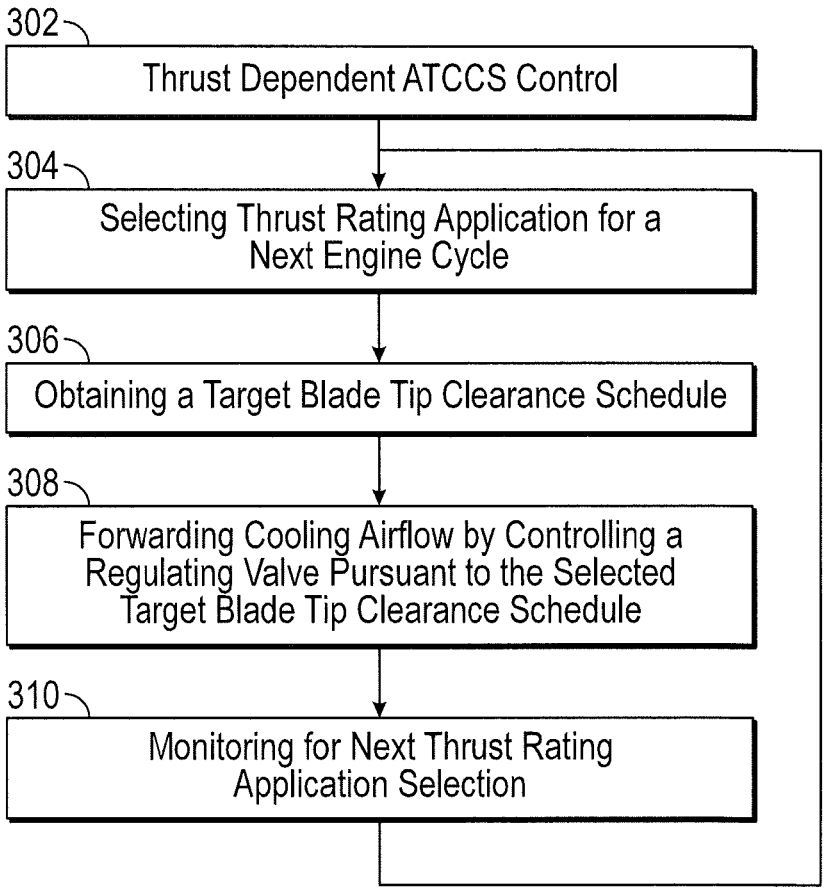
FIG. 7 illustrates a method of operating an active tip clearance control system, according to an embodiment.

FIG. 7 illustrates a method 302 for providing active tip clearance control to a gas turbine engine 110. A first step 304 includes selecting, by communicating with the EEC 142 before or after an engine cycle, a thrust rating application for a next engine cycle that differs from a currently selected thrust rating application.

This step 304 may occur proximate to engine install, such as at the time of install, or thereafter, but before a next engine run. This step 304 may occur well in advance of engine install, such after a last engine cycle in a prior application. This step 304 may include providing an automated query to persons responsible for assisting in this operation, and updating the EEC 142 based on a response. This step 304 may be automated, via an electronic communication between a specially programmed EEC 142 and the engine FADEC. To accomplish this step 304, the active tip clearance control system 114 may include an on-engine manual switch, which identifies thrust rating application options, and which electronically communicates with the EEC 142 for switching the operational parameters of the active tip clearance control system 114 to achieve the preferred target clearances.

A next step 306, includes the EEC 142 of the active tip clearance control system 114 obtaining a target blade tip clearance schedule for operating the valve 140. The schedule is obtained from of the plurality of target blade tip clearance schedules for the engine 110, each of the plurality of target blade tip clearance schedules correlating to one of the plurality of thrust rating applications for the engine 110. This step may include retrieving the preferred schedule stored within an on-board EEC, or using networked communications to receive the information from a remote data store.

A next step 308 is the EEC 142 of the active tip clearance control system 114 forwarding cooling airflow toward a turbine by controlling the electronically controlled regulating valve 140 pursuant to the selected target blade tip clearance schedule. A next step 310 is the active tip clearance control system 114, via the EEC 142, monitoring electronic communications for the engine 110 to identify when a new thrust rating application is selected, at which point the process cycles back to step 304.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An active tip clearance control system (ATCCS) for a gas turbine engine, comprising:

an electronically controlled regulating valve directing cooling airflow to a turbine case; and an engine electronic control (EEC), controlling the electronically controlled regulating valve, wherein:

the EEC is programmed to operate the valve pursuant to plural clearance target curves corresponding to plural anticipated thrust rating applications during a service life of the engine, the plural clearance target curves defining respective selected target blade tip clearance schedules, each of the target blade tip clearance schedules correlating to one of a plurality of thrust rating applications for the engine;

the EEC controls the electronically controlled regulating valve to regulate cooling airflow according to the selected target blade tip clearance schedule by monitoring electronic communications for the engine to identify when a new thrust rating application is selected, and selecting the target blade tip clearance schedule before an engine cycle, from target blade tip clearance schedules.

2. The active tip clearance control system of claim 1, wherein each of the target blade tip clearance schedules regulates cooling airflow for each phase of flight and for throttle excursions within and between each phase of flight.

3. The active tip clearance control system of claim 1, wherein the EEC is a full authority digital engine control (FADEC).

4. A turbine for a gas turbine engine, comprising the active tip clearance control system of claim 1, and further including a turbine case, a bladed rotary component supported by a spool, a shroud disposed radially within and fixedly supported by the turbine case, wherein blade tips are radially within and proximate to the shroud.

5. The turbine of claim 4, wherein the electronically controlled regulating valve is exterior to the turbine case, and cooling airflow is directed therefrom toward a radially exterior side of the turbine case, and against thermally exposed portions of the turbine case and shroud connectors.

6. A gas turbine engine including a turbine, the turbine comprising:

a bladed rotary component supported by a spool;

a turbine case; and an active tip clearance control system (ATCCS), including:

an electronically controlled regulating valve directing cooling airflow to a turbine case; and an engine electronic control (EEC), controlling the electronically controlled regulating valve, wherein:

the EEC is programmed to operate the valve pursuant to plural clearance target curves corresponding to plural anticipated thrust rating applications during a service life of the engine, the plural clearance target curves defining respective selected target blade tip clearance schedules, each of the target blade tip clearance schedules correlating to one of a plurality of thrust rating applications for the engine;

the EEC controls the electronically controlled regulating valve to regulate cooling airflow according to the selected target blade tip clearance schedule by monitoring electronic communications for the engine to identify when a new thrust rating application is selected, and selecting the target blade tip clearance schedule before an engine cycle, from the target blade tip clearance schedules.

7. The gas turbine engine of claim 6, wherein each of the target blade tip clearance schedules regulates cooling airflow for each phase of flight and for throttle excursions within and between each phase of flight.

8. The gas turbine engine of claim 6, wherein the EEC is a full authority digital engine control (FADEC).

9. The gas turbine engine of claim 6, including a shroud disposed radially within and fixedly supported by the turbine case, wherein the blade tips are radially within and proximate to the shroud.

10. The gas turbine engine of claim 9, wherein the electronically controlled regulating valve is exterior to the turbine case, and cooling airflow is directed therefrom toward a radially exterior side of the turbine case, and against thermally exposed portions of the turbine case and shroud connectors.

11. A method for providing active tip clearance control to a gas turbine engine, the method comprising:

programming a computer processor to operate an electronically controlled regulating valve pursuant to plural clearance target curves corresponding to plural anticipated thrust rating applications during a service life of the gas turbine engine, the plural clearance target curves defining respective selected target blade tip clearance schedules;

monitoring, with the computer processor, electronic communications for the engine to identify when a new thrust rating application is selected;

selecting, with the computer processor, after an engine cycle of the gas turbine engine, a thrust rating application for a next engine cycle that differs from a currently selected thrust rating application;

obtaining, by the computer processor, a target blade tip clearance schedule from of a plurality of target blade tip clearance schedules, each of the plurality of target blade tip clearance schedules correlating to one of a plurality of thrust rating applications for the engine; and forwarding cooling airflow toward a turbine case by controlling the electronically controlled regulating valve pursuant to the selected target blade tip clearance schedule.

12. The method of claim 11, wherein each of the target blade tip clearance schedules regulates cooling airflow for each phase of flight and for throttle excursions within and between each phase of flight.

13. The method of claim 11, including a shroud disposed radially within and fixedly supported by the turbine case, wherein blade tips are radially within and proximate to the shroud.

14. The method of claim 13, wherein the electronically controlled regulating valve is exterior to the turbine case, and cooling airflow is directed therefrom toward a radially exterior side of the turbine case, against thermally exposed portions of the turbine case and shroud connectors.

* * * * *